US007934851B1

(12) United States Patent
Boissevain et al.

(10) Patent No.: US 7,934,851 B1
(45) Date of Patent: May 3, 2011

(54) VERTICAL LUMINAIRE

(75) Inventors: Chris Boissevain, Wimberley, TX (US); Joseph Garcia, San Antonio, TX (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 169 days.

(21) Appl. No.: 12/210,836

(22) Filed: Sep. 15, 2008

Related U.S. Application Data

(60) Provisional application No. 61/090,216, filed on Aug. 19, 2008.

(51) Int. Cl.
*F21V 1/00* (2006.01)

(52) U.S. Cl. ..... 362/241; 362/249.02; 362/431

(58) Field of Classification Search ..... 362/217.02, 362/217.03, 217.04, 217.05, 235, 237, 241, 362/242, 243, 247, 249.02, 431
See application file for complete search history.

(56) References Cited

U.S. PATENT DOCUMENTS

| | | | |
|---|---|---|---|
| 492,320 | A | 2/1893 | Bodkin |
| 1,484,978 | A | 2/1924 | Wheeler |
| 2,428,630 | A | 10/1947 | Lanter |
| 3,193,001 | A | 7/1965 | Meckler |
| 3,311,743 | A | 3/1967 | Moore |
| 3,372,740 | A | 3/1968 | Kastovich et al |
| 3,596,136 | A | 7/1971 | Fischer |
| 3,801,815 | A | 4/1974 | Docimo |
| 3,845,292 | A | 10/1974 | Koziol |
| 3,890,126 | A | 6/1975 | Joseph |
| 4,081,023 | A | 3/1978 | Edelstein et al. |
| 4,321,656 | A | 3/1982 | Gruver, Jr. |
| 4,503,360 | A | 3/1985 | Bedel |
| 4,509,106 | A | 4/1985 | Meyer et al. |
| 4,729,076 | A | 3/1988 | Masami et al. |
| 4,734,835 | A | 3/1988 | Vines et al. |
| 4,860,177 | A | 8/1989 | Simms |
| 4,871,944 | A | 10/1989 | Skwirut et al. |
| 4,941,072 | A | 7/1990 | Yasumoto |
| 4,954,822 | A | 9/1990 | Borenstein |
| 5,010,452 | A | 4/1991 | Krebser et al. |
| 5,136,287 | A | 8/1992 | Borenstein |
| 5,138,541 | A | 8/1992 | Kano |
| 5,351,172 | A | 9/1994 | Attree et al. |
| 5,537,301 | A | 7/1996 | Martich |
| 5,548,499 | A | 8/1996 | Zadeh |
| 5,636,057 | A | 6/1997 | Dick |
| 5,688,042 | A | 11/1997 | Madadi et al. |
| 5,785,418 | A | 7/1998 | Hochstein |
| 5,924,788 | A | 7/1999 | Parkyn |
| 5,980,071 | A | 11/1999 | Hsieh |
| 5,993,027 | A | 11/1999 | Yamamoto et al. |
| 6,045,240 | A | 4/2000 | Hochstein |
| 6,050,707 | A | 4/2000 | Kondo et al. |
| 6,068,384 | A | 5/2000 | Tyson et al. |
| 6,154,362 | A | 11/2000 | Takahashi et al. |
| 6,183,114 | B1 | 2/2001 | Cook et al. |
| 6,193,603 | B1 | 2/2001 | Tai |

(Continued)

FOREIGN PATENT DOCUMENTS

| | | |
|---|---|---|
| JP | 11154766 | 8/1999 |

(Continued)

*Primary Examiner* — John A Ward

(57) ABSTRACT

A luminaire is provided with a housing having an attachment element and a LED mounting element. A plurality of LEDs are also provided and are supported by the LED mounting element of the housing. A plurality of reflectors are positioned proximal to the plurality of LEDs and reflect light emitted by the LEDs toward an illumination surface.

21 Claims, 17 Drawing Sheets

U.S. PATENT DOCUMENTS 6,350,043 B1 2/2002 Gloisten
6,350,046 B1 2/2002 Lau
6,367,949 B1 4/2002 Pederson
6,379,024 B1 4/2002 Kogure et al.
6,402,346 B1 6/2002 Liao et al.
6,502,962 B1 1/2003 Menke et al.
6,560,038 B1 5/2003 Parkyn et al.
6,573,536 B1 6/2003 Dry
6,632,006 B1 10/2003 Rippel et al.
6,678,168 B2 1/2004 Kenny, Jr. et al.
6,705,751 B1 3/2004 Liu
6,815,724 B2 11/2004 Dry
6,860,628 B2 3/2005 Robertson et al.
6,871,983 B2 3/2005 Jacob et al.
6,905,227 B2 6/2005 Wu
6,955,440 B2 10/2005 Niskamen
6,965,715 B2 11/2005 Lei et al.
6,974,233 B1 12/2005 Aubrey
6,986,593 B2 1/2006 Rhoads
6,994,452 B2 2/2006 Rozenberg et al.
6,997,583 B2 2/2006 Broelemann
7,014,341 B2 3/2006 King et al.
7,098,486 B2 8/2006 Chen
7,104,672 B2 9/2006 Zhang
7,140,753 B2 11/2006 Wang et al.
7,182,480 B2 * 2/2007 Kan ..... 362/242
7,182,547 B1 * 2/2007 Leonhardt et al. ..... 404/9
7,307,546 B1 12/2007 Partap
7,322,718 B2 1/2008 Setomoto et al.
7,325,998 B2 * 2/2008 Leonhardt et al. ..... 404/9
7,329,031 B2 2/2008 Liaw et al.
7,348,723 B2 3/2008 Yamaguchi et al.
7,387,405 B2 6/2008 Ducharme et al.
7,440,280 B2 10/2008 Shuy
7,524,089 B2 4/2009 Park
2002/0122309 A1 9/2002 Abdelhafez et al.
2004/0120152 A1 6/2004 Bolta et al.
2004/0141326 A1 7/2004 Dry
2005/0030761 A1 2/2005 Burgess
2005/0036322 A1 2/2005 Veffer
2005/0110649 A1 * 5/2005 Fredericks et al. ..... 340/815.45
2005/0122229 A1 6/2005 Stevenson et al.
2005/0168986 A1 8/2005 Wegner
2005/0190567 A1 9/2005 Childers et al.
2005/0207168 A1 9/2005 Chabert
2005/0276053 A1 12/2005 Nortrup et al.
2006/0109661 A1 5/2006 Coushaine et al.
2006/0164843 A1 7/2006 Adachi et al.
2006/0193139 A1 8/2006 Sun et al.
2006/0209545 A1 9/2006 Yu
2006/0215408 A1 9/2006 Lee
2006/0262545 A1 11/2006 Piepgras et al.
2007/0030686 A1 2/2007 Haugaard et al.
2007/0211470 A1 9/2007 Huang
2007/0230172 A1 10/2007 Wang
2007/0230183 A1 10/2007 Shuy
2007/0230184 A1 10/2007 Shuy
2007/0247853 A1 10/2007 Dorogi
2007/0279909 A1 12/2007 Li
2008/0007955 A1 1/2008 Li
2008/0043472 A1 2/2008 Wang
2008/0080188 A1 4/2008 Wqang
2008/0084701 A1 4/2008 Van De Ven et al.
2008/0158887 A1 7/2008 Zhu et al.
2008/0165535 A1 7/2008 Mazzochette
2008/0204888 A1 8/2008 Kan et al.
2008/0205062 A1 8/2008 Dahm et al.
2008/0212333 A1 9/2008 Chen
2008/0304269 A1 12/2008 Pickard et al.
2008/0316755 A1 * 12/2008 Zheng et al. ..... 362/373
2009/0080189 A1 3/2009 Wegner
2009/0086476 A1 4/2009 Wegner et al.
2009/0086481 A1 4/2009 Wegner
2009/0116233 A1 * 5/2009 Zheng et al. ..... 362/234

FOREIGN PATENT DOCUMENTS

JP 2006172895 6/2006
JP 2008171584 7/2008

* cited by examiner

VERTICAL LUMINAIRE

CROSS-REFERENCE TO RELATED APPLICATIONS

This application under 35 USC §119(e) claims priority to, and benefit from, U.S. Provisional Application No. 61/090,216 filed Aug. 19, 2008, entitled "Vertical Luminaire," which is currently pending and names Chris Boissevain as an inventor.

TECHNICAL FIELD

This invention pertains to luminaires, and more specifically to luminaires having light emitting diodes as a light source.

BRIEF DESCRIPTION OF THE ILLUSTRATIONS

DETAILED DESCRIPTION

Figure 1:
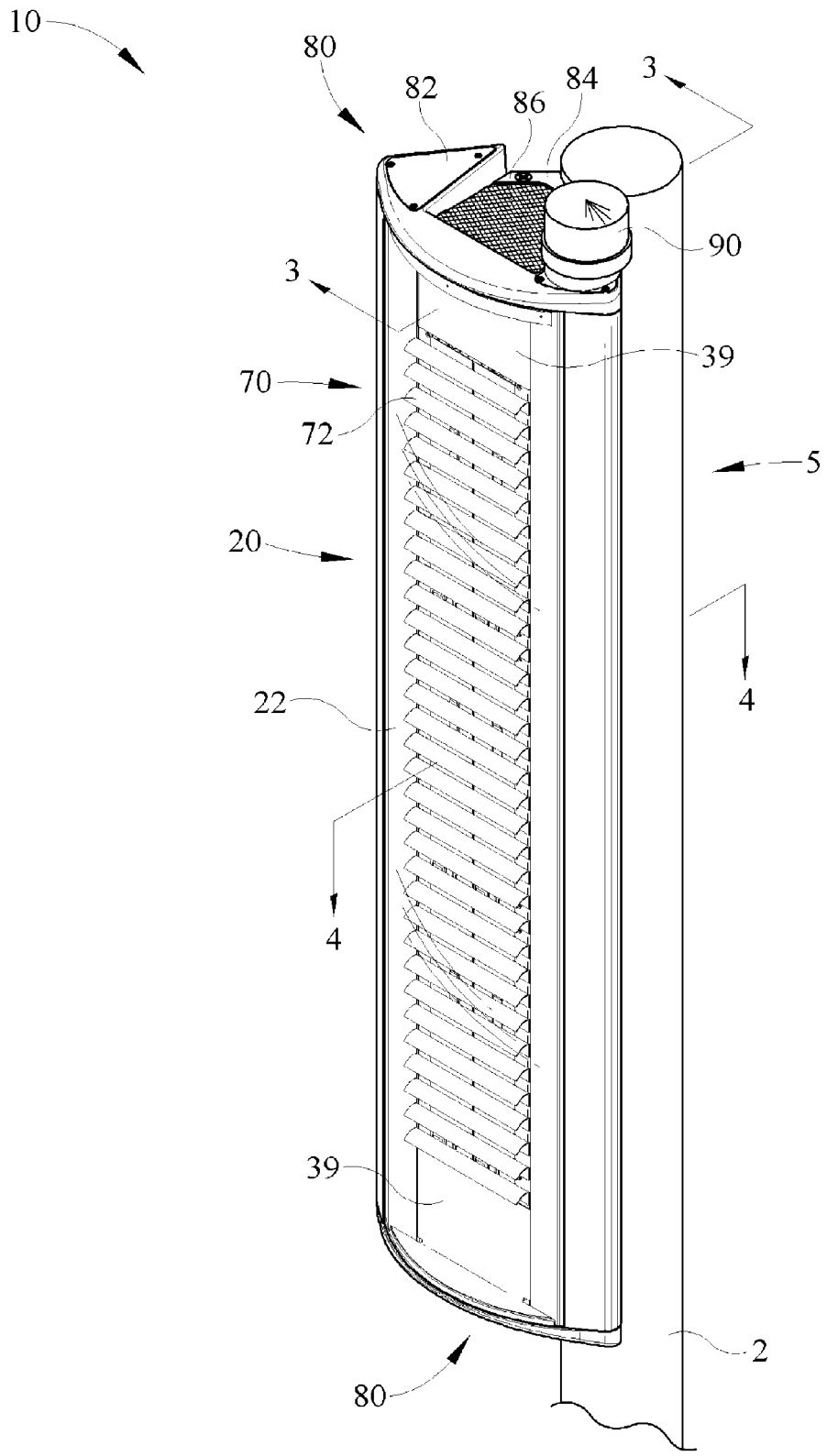
FIG. 1 is a top perspective view of an embodiment of a luminaire of the present invention placed about a support pole

Referring now to FIG. 1, one embodiment of a luminaire 10 is shown attached about housing attachment portion 5 of a support pole 2. Support pole 2 also has an installation portion (not shown) that may be placed into the ground, or placed in or secured to another surface to help secure support pole 2. Two cap assemblies 80 are provided on a first and second end of housing 20 and help to enclose luminaire 10. A cap door 82 is visible on one end of housing 20 and forms part of cap assembly 80 in the depicted embodiment, allowing access to internal portions of luminaire 10 without removing the entirety of cap 80. An attachment cap 84 is also shown proximal to support pole 2 in the depicted embodiment and likewise helps to enclose luminaire 10. A light detector 90 also forms part of cap assembly 80 in the depicted embodiment and is placed to accurately determine ambient light conditions. A permeable mesh cap 86 also forms part of cap assembly 80 in the depicted embodiment and allows air to pass therethrough to aid in cooling of luminaire 10. An acrylic lens 22 further encloses luminaire 10 and is provided proximal a reflector assembly 70 comprising a plurality of louver reflectors 72. Acrylic lens 22 is also proximal cover plates 39 and allows light to pass therethrough with little or no alteration.

Depending on characteristics of luminaire 10 and on the particular illumination needs, luminaire 10 may be mounted about a support pole 2 at a number of distances from the surface to be illuminated. Moreover, as will become more clear, luminaire 10 may take on a number of embodiments to be compatible with a number of support poles, with other mounting surfaces, or other mounting configurations.

Although cap assembly 80 is shown in detail in many Figures, it is merely representative of one embodiment of the invention. There are a variety of different shapes, constructions, orientations, and dimensions of cap assembly 80 that may be used as understood by those skilled in the art. For example, in some embodiments cap assembly 80 may be provided with more than one cap door 82, a different shaped cap door 82, or without cap door 82. Also, for example, in some embodiments attachment cap 84 is not a separate piece. Also, light detector 90 may interface with luminaire 10 in some embodiments to selectively illuminate luminaire 10 based on ambient light levels. As will become clear, light detector 90 may also interface with luminaire 10 in some embodiments to selectively illuminate different portions of luminaire 10 based on ambient light level. Also, luminaire 10 may interface with light detector 90 in a different manner or be provided without a light detector 90 in some embodiments.

Figure 2:
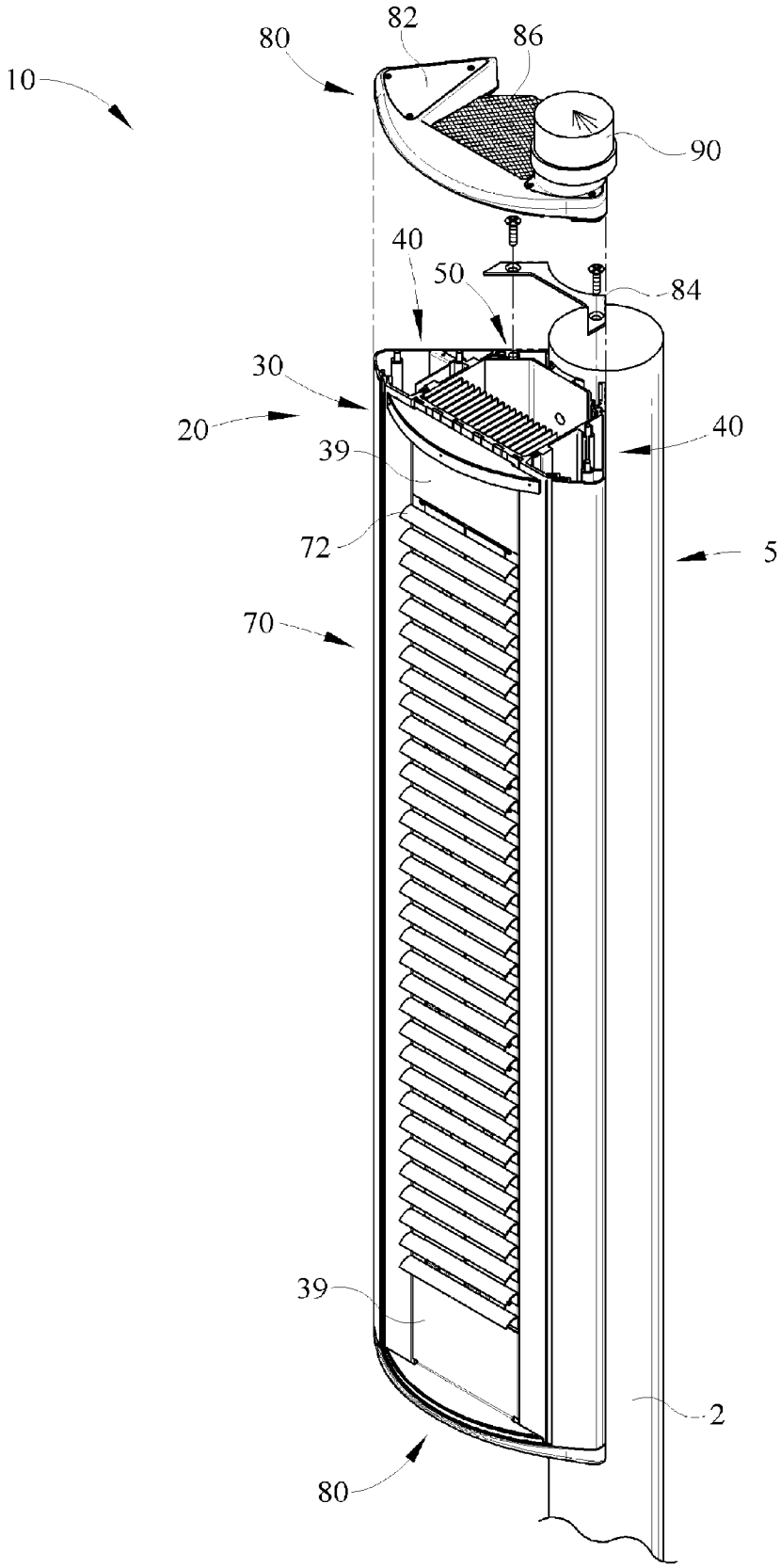
FIG. 2 is a top perspective view of the luminaire and support pole of FIG. 1 with a lens removed and a cap assembly exploded away.

Referring now to FIG. 2, luminaire 10 of FIG. 1 is shown with acrylic lens 22 removed and with one cap assembly 80 exploded away from housing 20. Attachment element 50, electronics housing element 40, and LED mounting element 30 form part of housing 20 in the embodiment of the Figures and are visible in FIG. 2 where cap assembly 80 has been removed.

Figure 3:
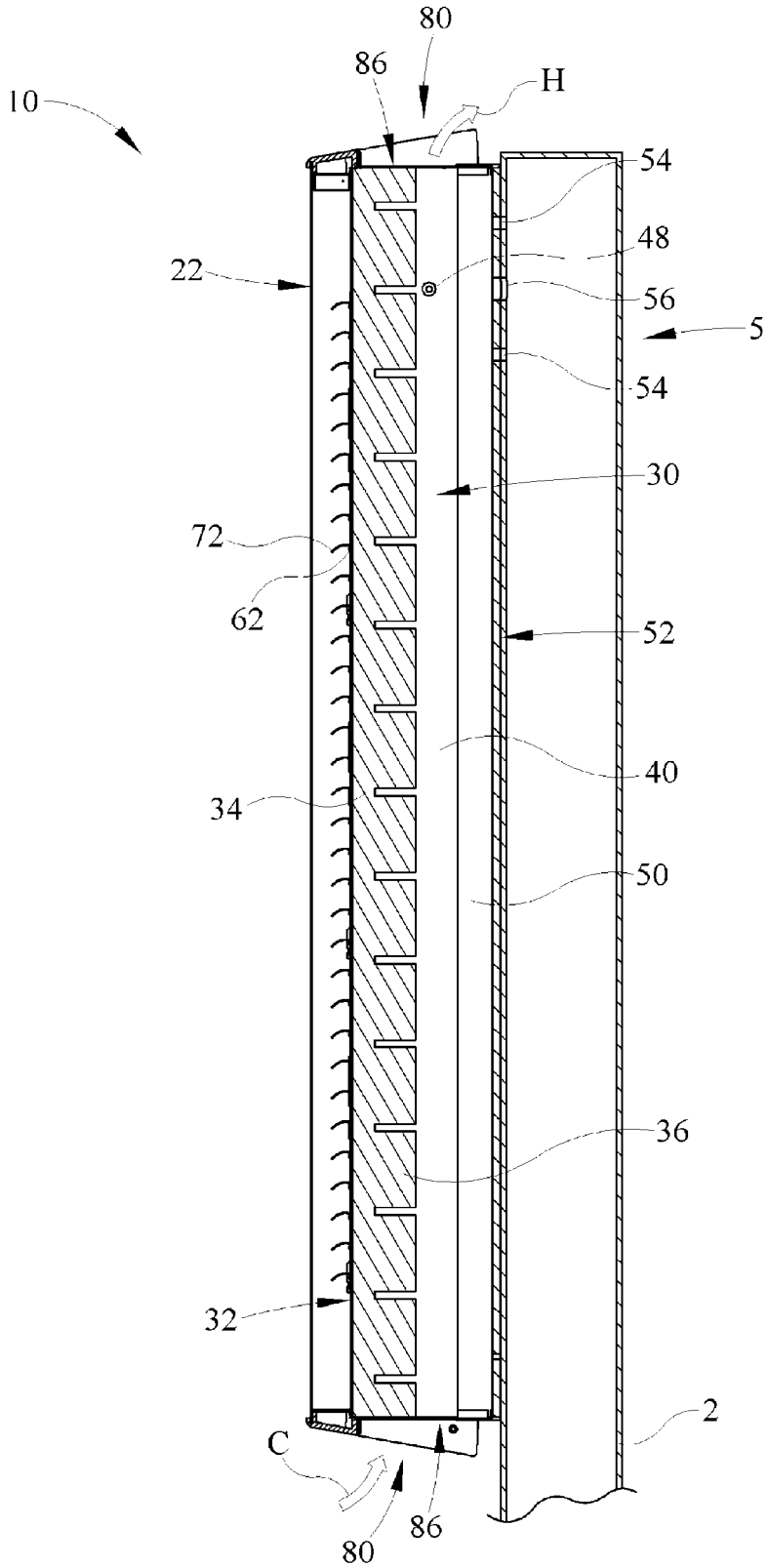
FIG. 3 is a sectional view of the luminaire and support pole of FIG. 1 taken along the line 3-3.
Figure 4:
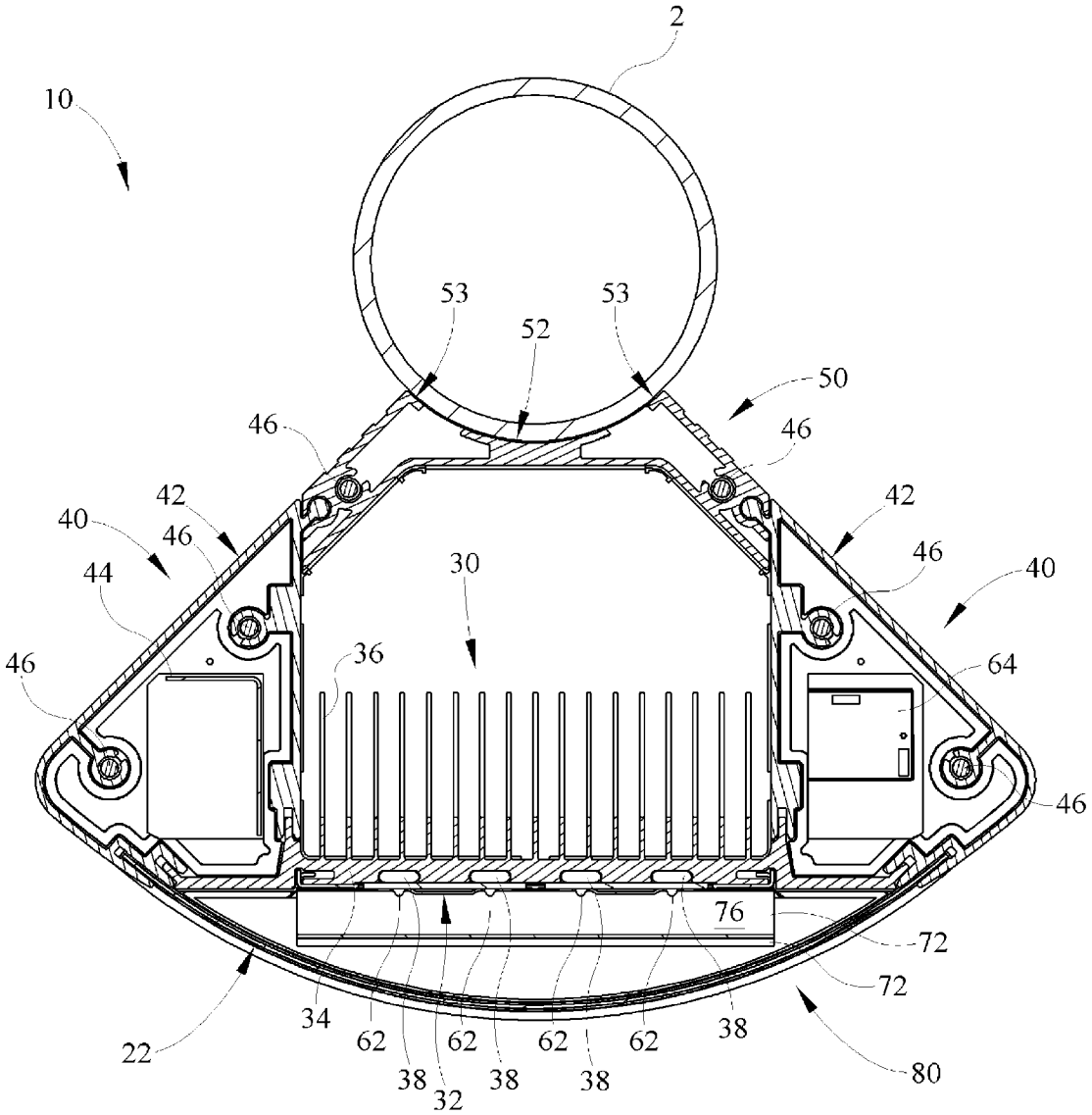
FIG. 4 is a sectional view of the luminaire and support pole of FIG. 1 taken along the line 4-4.
Figure 5:
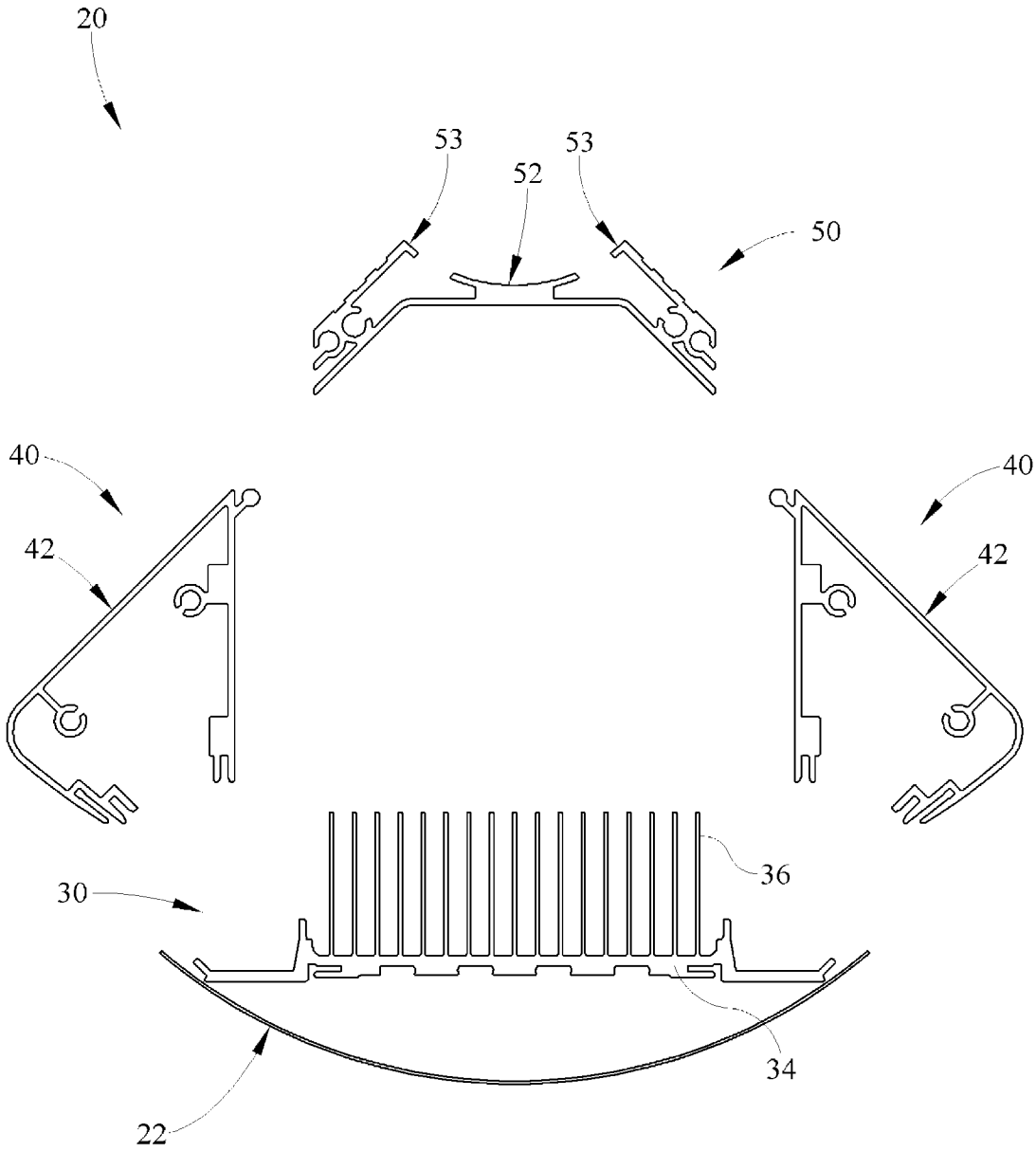
FIG. 5 is an exploded plan view of an attachment element, two electronics housings, an LED mounting element, and a lens of the luminaire of FIG. 1.

Referring now to FIG. 3 through FIG. 6, attachment element 50 has pole attachment portions 52 and 53. As shown in FIG. 3 and FIG. 4, pole attachment portions 52 and 53 abut pole 2 when luminaire is placed about pole 2. A pair of securing apertures 54 extend through attachment portion 52 and pole 2. Securing apertures 54 may receive bolts or other securing devices that may interact with a bolster plate or other device within pole 2 to secure luminaire 10 to pole 2. An electrical aperture 56 also extends through attachment portion 52 and pole 2 and provides a throughway for electrical wiring to luminaire 10.

Two electronics housing elements 40 are connected to attachment element 50. Electronics housing elements 40 and attachment element 50 have interlocking parts for connection to one another and are further secured by a plurality of connection rods 46. Connection rods 46 extend through electronics housing elements 40 and attachment element 50 and interact with both cap assemblies 80 to maintain housing 20 as a connected whole. Each electronics housing element 40 has an exterior wall portion 42 that extends away from attachment element 50 at a divergent angle with respect to the other exterior wall portion 42. In the embodiment of the Figures, the angle between both exterior wall portions 42 is approximately ninety degrees.

Electronics housing elements 40 may house electrical components, such as a LED driver 64 and may also have components such as a LED driver tray 44 to help house components. When cap assemblies 80 are placed on luminaire 10, components housed by electronics housing elements 40 may be protected from water, dust, or other undesirable elements. Of course, one or more cap doors 82 may provide access to electronics housing elements 40 or cap assemblies may be removed to gain access to electronics housing elements 40. A grommet, such as grommet 48 may extend through an interior wall of each housing element 40 to allow for the passage of electrical wiring to LED driver 64 or other electrical component. Also, each electronics housing element 40 may contain a notch to help support a lens, such as acrylic lens 22. Cap assemblies 80 or other portions of housing 20 may alternatively or also help to support a lens.

In the embodiments of the Figures, attachment element 50, electronics housing element 40, and LED mounting element 30 create a void in the interior of housing 20 that serves as an airway shaft. LED mounting element 30 has heat fins 36 that extend into the airway shaft and that are in thermal connectivity with a heat dissipation plate 34 and heat pipes 38. Heat dissipation plate 34 is in thermal connectivity with an LED mounting surface 32 that supports a plurality of LEDs 62. Heat generated by plurality of LEDs 62 is transferred to heat dissipation plate 34. Even distribution of heat to heat dissipation plate 34 is aided by heat pipes 38 which utilize phase change to transfer heat from hotter portions of heat dissipation plate 34 to cooler portions of heat dissipation plate 34. This heat is further distributed to fins 36.

When luminaire 10 is installed in a somewhat vertical configuration, this transfer of heat by LED mounting element 30 warms the air in airway shaft and causes the warmed air to draft upward and exit out of the upper mesh cap 86. This is depicted by heated air H in FIG. 3 exiting mesh cap 86. This causes cooler ambient air to be drafted through the lower mesh cap 86 and replace the exiting heated air in the airway shaft. This is depicted by cooler air C in FIG. 3 entering mesh cap 86. This exchange of air is known as the chimney effect and aides in cooling the electrical components of luminaire 10 that are in thermal connectivity with the airway shaft.

Although housing 20, and its constituent parts, such as, but not limited to, attachment element 50, electronics housing element 40, and LED mounting element 30 are shown in detail in FIG. 1 through FIG. 6, they are merely representative of one embodiment of the invention. There are a variety of shapes, construction, orientations, and dimensions of housing 20 that may be used as understood by those skilled in the art. For example, by varying attachment area 50, one skilled in the art can make luminaire 10 attachable to a different shape of support pole, a different support, or a different mounting configuration all together. Thus, luminaire 10 may be wall mounted, pendant mounted, or otherwise mounted.

Figure 16:
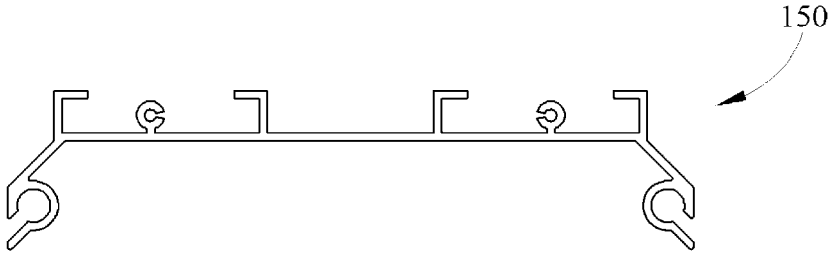
FIG. 16 is a plan view of a second embodiment of an attachment element.
Figure 17:
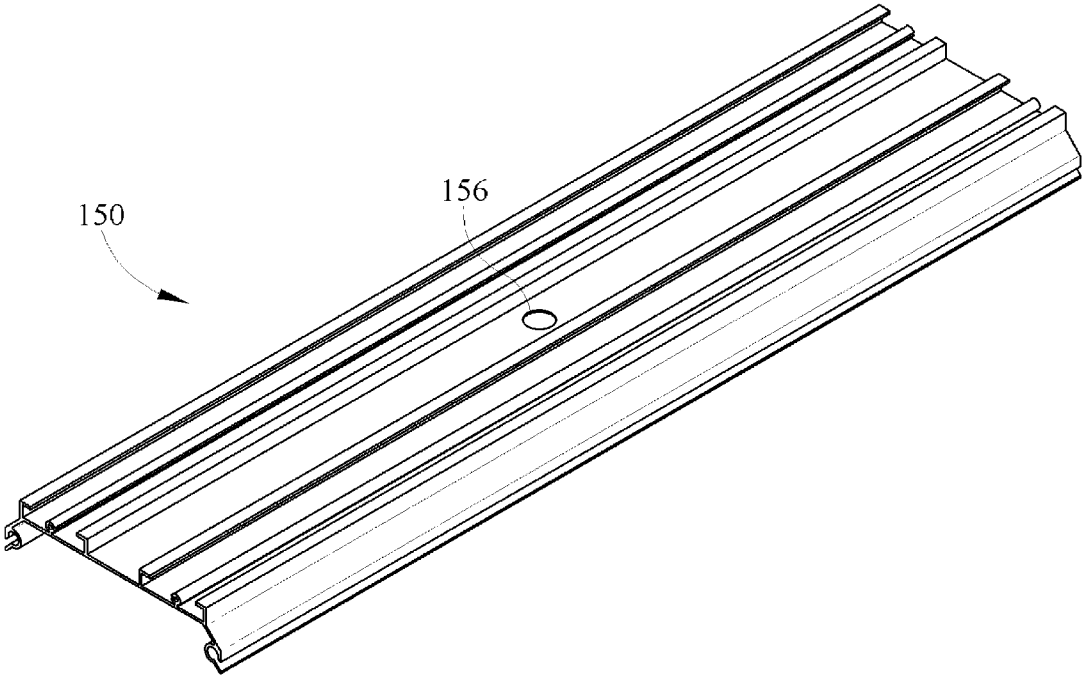
FIG. 17 is a perspective view of the attachment element of FIG. 16.

Referring to FIGS. 16 and 17 a second embodiment of an attachment area 150 is shown. Attachment area 150 may be interchanged with attachment area 50 for mounting luminaire 10 to a wall or other flat surface. An electrical aperture 156 extends through attachment area 150 and provides a throughway for electrical wiring to luminaire 10. Securing apertures (not shown) may receive bolts, screws, or other securing devices that may secure luminaire 10 to a junction box or a wall, for example. Attachment area 150 may be first secured to a wall, then interlocked with electronics housing elements 40 and LED mounting element 30, then secured with cap assemblies 80.

Figure 18:
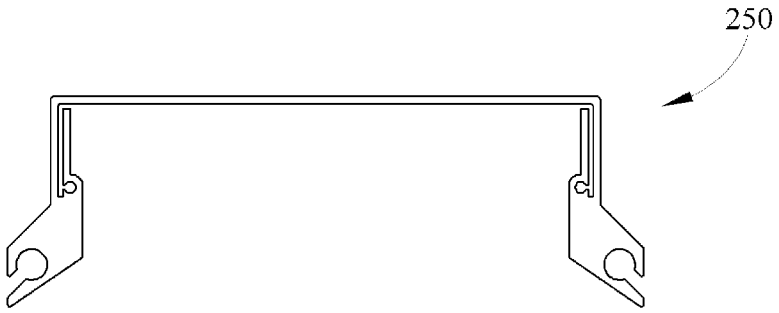
FIG. 18 is a plan view of a third embodiment of an attachment element.
Figure 19:
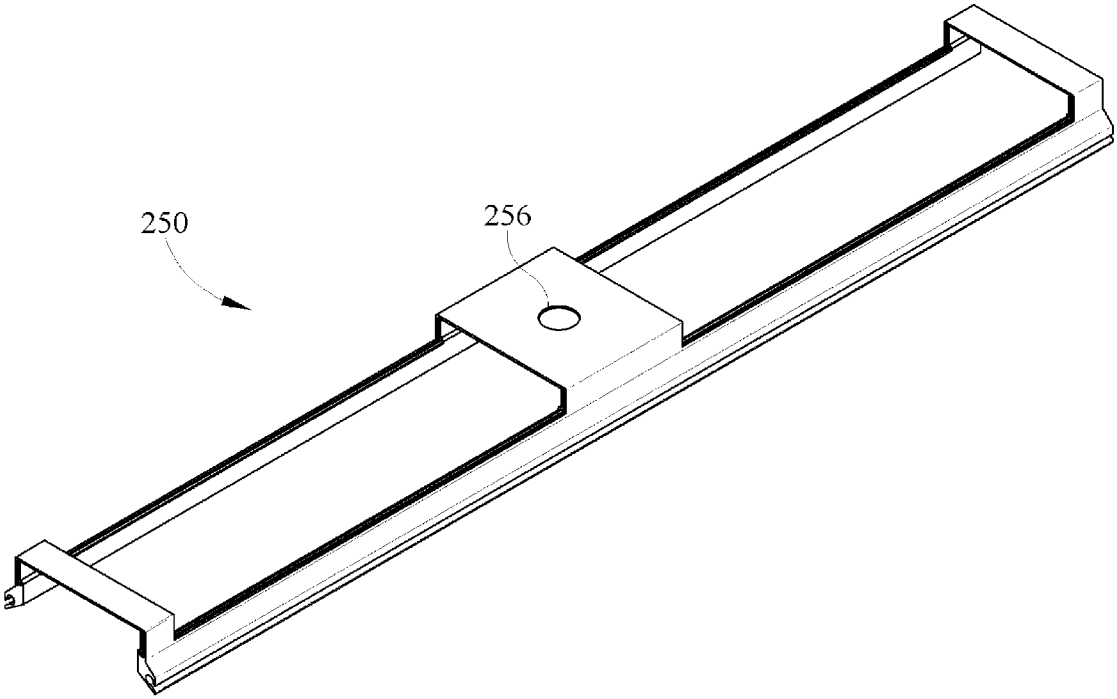
FIG. 19 is a perspective view of the attachment element of FIG. 18.

Referring to FIGS. 18 and 19 a third embodiment of an attachment area 250 is shown. Attachment area 250 may be interchanged with attachment area 50 for pendant mounting luminaire 10 or for mounting luminaire 10 to a ceiling or other flat surface. An electrical aperture 256 extends through attachment area 250 and provides a throughway for electrical wiring to luminaire 10. Securing apertures (not shown) may receive bolts, screws, or other securing devices that may secure luminaire 10 to a ceiling or a junction box, for example. Hanger bars or the like may also interface with the end portions of attachment area 250 to pendant mount luminaire 10 from a ceiling, for example. Attachment area 250 may also interlock with electronics housing elements 40 and LED mounting element 30. Moreover, a mesh or solid covering may be provided with attachment area 250 to fully enclose luminaire 10.

Figure 6:
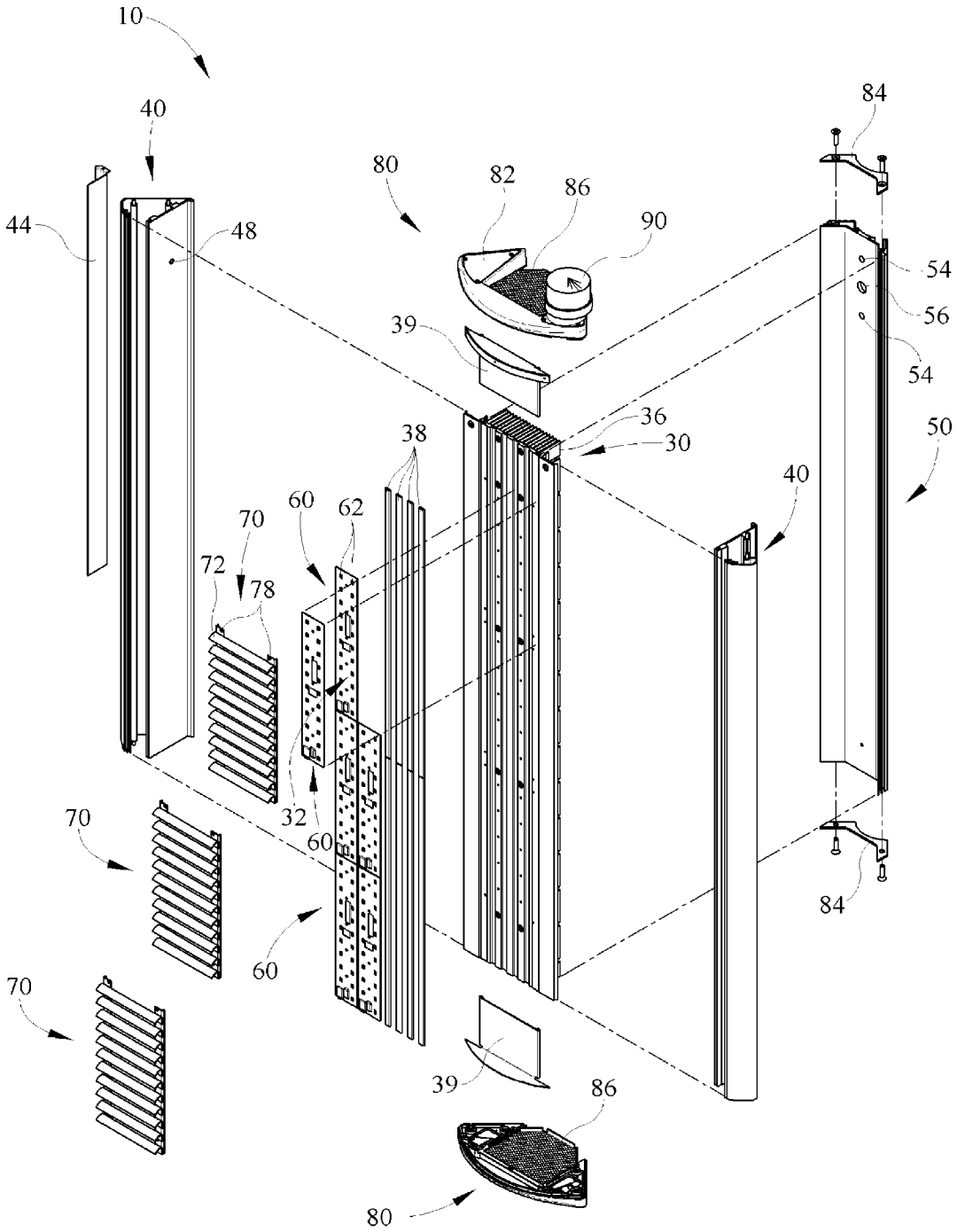
FIG. 6 is an exploded top perspective view of the luminaire of FIG. 1.

Referring particularly to FIG. 6, a plurality of LED light engines 60 are each supported by LED mounting element 30. Each LED light engine 60 in FIG. 6 has eleven rows of LEDs and a total of 21 LEDs. Also, each LED light engine 60 has an LED mounting surface 32 that supports the LEDs and is in thermal connectivity with heat dissipation plate 34, as shown in FIG. 4. In the depicted embodiments six LED light engines 60 are placed in three rows of two LED light engines 60 each. Three reflector assemblies 70 are also supported by mounting element 30, each having eleven louver reflectors 72 connected by a reflector frame 78. Each louver reflector 72 of reflector assembly 70 corresponds to a row of LEDs 62 on a pair of LED light engines 60. In the depicted embodiment, ten louver reflectors 72 of reflector assembly 70 correspond to a row of LEDs 62 with four LEDs 62 and one louver reflector 72 of reflector assembly 70 corresponds to a row of two LEDs 62.

By having modular LED light engines 60 and reflector assemblies 70, such as those shown in FIG. 6, luminaire 10 may be inexpensively manufactured to various sizes and various light outputs. For example, a luminaire with two side by side light engines 60 and one corresponding reflector assembly 70 may be constructed by simply cutting LED mounting element 30, electronics housing element 40, and attachment portion 50 to a shorter height. Two LED light engines 60 and one reflector assembly 70 may then be mounted to LED mounting element 30. It will be appreciated that the same cap assembly 80 may be used with a smaller or larger luminaire as described. It will also be appreciated that the same tooling may be used to create mounting element 30, electronics housing element 40, and attachment portion 50, with the only difference being the cut length.

Although light engines 60 and reflector assemblies 70 are shown in detail throughout many Figures, they are merely representative of one embodiment of the invention. There are a variety of quantities, shapes, construction, orientations, and dimensions of light engines 60 and reflector assemblies 70 that may be used as understood by those skilled in the art. For example, light engines 60 may have a different amount of LEDs, a different number of rows of LEDs, or different placement of LEDs. Moreover, a single integral light engine 60 or single reflector assembly 70 may be used. Also, for example, reflector assemblies 70 may be mounted to many parts of luminaire 10.

As will be described in more detail below, luminaire 10 may be configured to emit a variety of light distribution patterns. When only one housing 20 and other internal components comprise luminaire 10, such as shown in FIG. 1, luminaire 10 may be configured to emit IESNA Type III or Type IV light distributions. Of course, other light distribution patterns are achievable.

Figure 7:
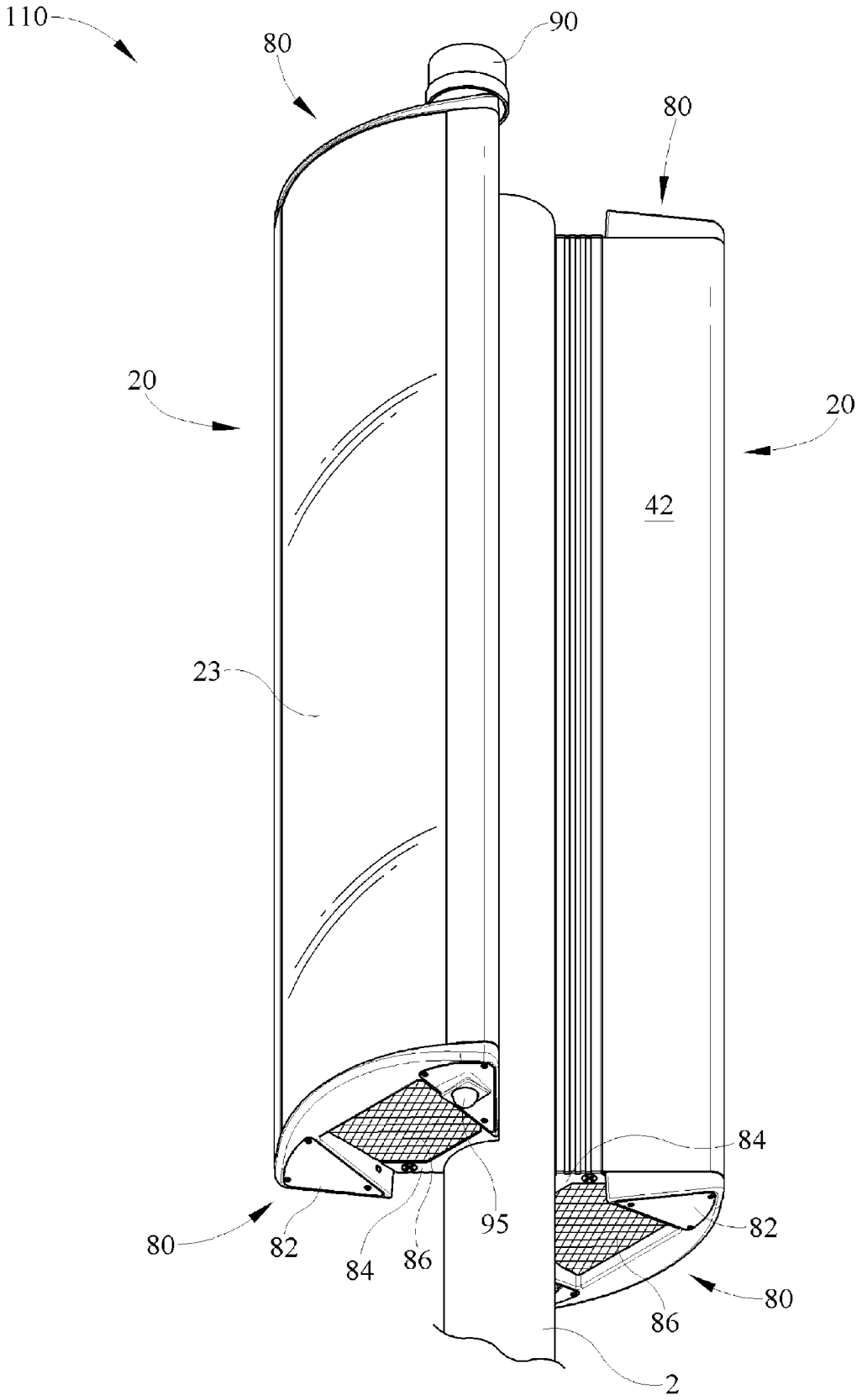
FIG. 7 is a bottom perspective view of another embodiment of a luminaire of the present invention placed about a support pole.
Figure 8:
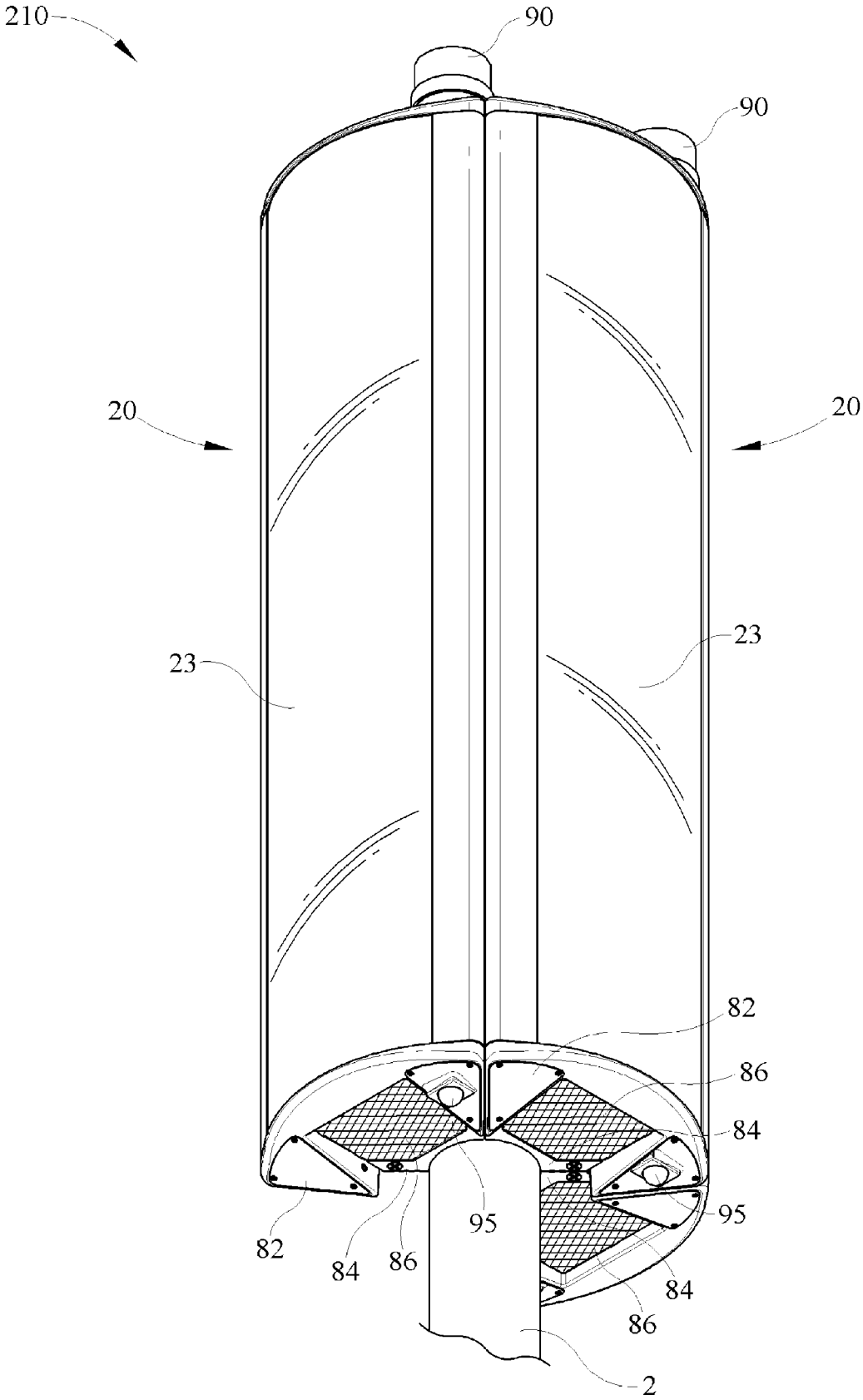
FIG. 8 is a bottom perspective view of another embodiment of a luminaire of the present invention placed about a support pole.
Figure 9:
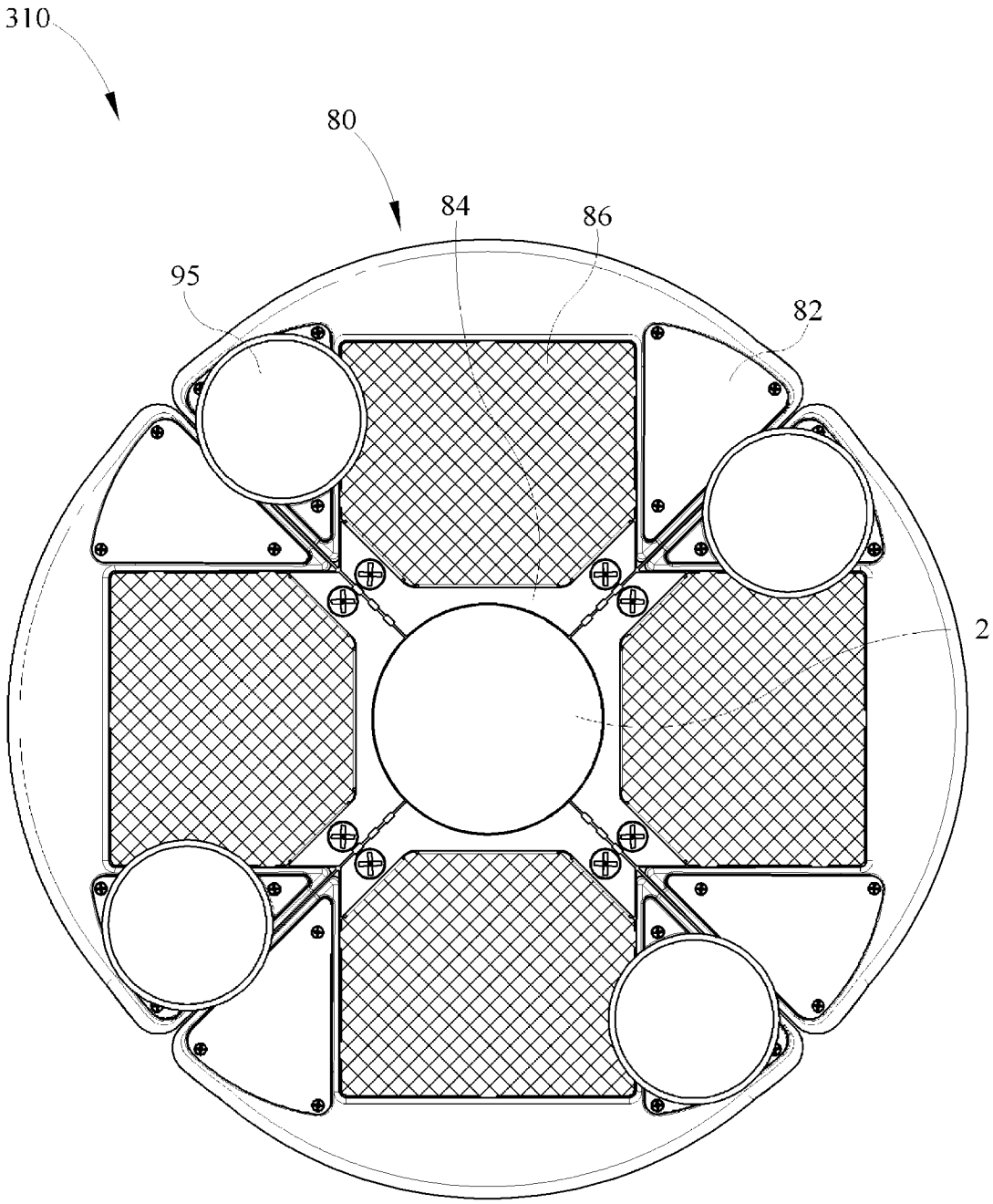
FIG. 9 is a top view of another embodiment of a luminaire of the present invention placed about a support pole.

Referring to FIG. 7, two housings 20 and other internal components comprise luminaire 110. Housings 20 of luminaire 110 are positioned on opposed sides of support pole 2. In other embodiments, two housings 20 may be otherwise spaced from one another or contiguous to one another. One housing 10 of luminaire 11, is shown with a diffusing lens 23 that alters the direction of light rays passing therethrough. Referring to FIG. 8, three housings 20 and other internal components comprise luminaire 210. The housings 20 are positioned contiguous to one another on pole 2. In other embodiments, three housings 20 may be equidistantly or otherwise spaced from one another. Both housings 20 of luminaire 210, are also shown with a diffusing lens 23. Referring to FIG. 9, four housings 20 and other internal components comprise luminaire 310.

Although attachments of housings 20 to support pole 2 have been shown, they are merely representative of some embodiments of the invention. There are a variety of shapes, construction, orientations, and dimensions of attachment area 50 and support pole 2 that may be used as understood by those skilled in the art. For example, support pole 2 may be of a square shape and attachment area 50 adapted to interface with a square shape.

Each housing 20 and its internal components of luminaires 110, 210, and 310 may be configured to emit any number of light distribution patterns. For example, in FIG. 9 each housing 20 and its internal components could be configured to emit a Type III distribution pattern. Thus, when fully powered, luminaire 310 would emit a Type V light distribution pattern. Also, each housing 20 and its internal components of luminaires 110, 210, and 310 may be operated independently of other housings 20 and their corresponding internal components. For example, and again with reference to FIG. 9, each housing 20 could be configured to emit a Type III distribution pattern and only one, two, or three housings 20 and their corresponding internal components may emit light at any given time. Thus, if luminaire 310 is in use in a store parking lot it could emit less than full output around dusk, dawn, or during hours when the store is closed. Luminaire 310 could interface with light detector 90, a motion detector 95, or any electronic device to control its light output.

Figure 10:
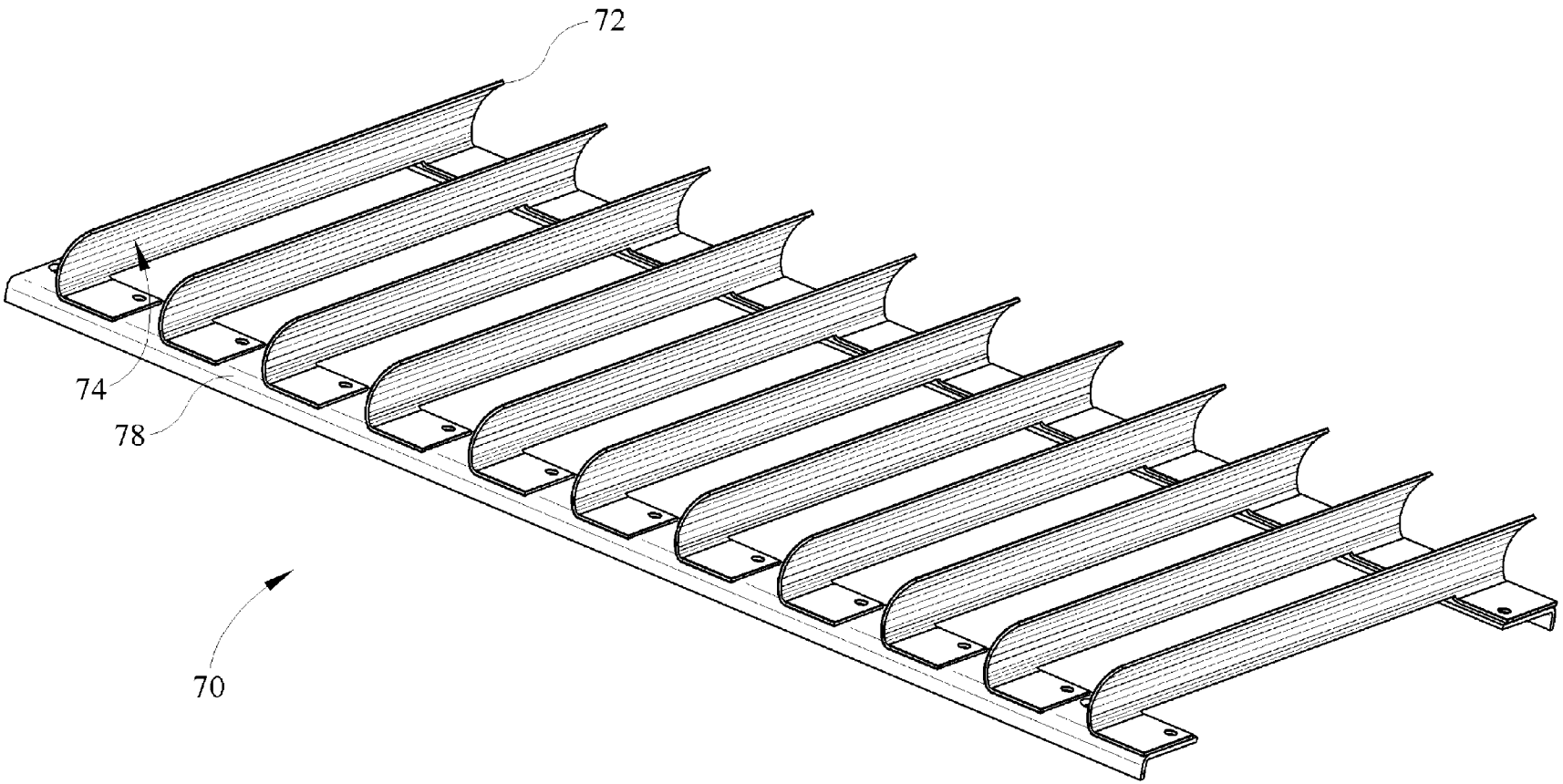
FIG. 10 is a bottom perspective view of one louver reflector assembly of the luminaire of FIG. 1.

Referring now to FIG. 10, one embodiment of reflector assembly 70 is described in more detail. Reflector assembly 70 has eleven louver reflectors 72 connected in parallel orientation to one another by reflector frame 78. Each louver reflector 72 has an inner concave reflective surface 74. In some embodiments louver reflectors 72 are constructed from reflective aluminum sheet metal. Although reflector assembly 70 is shown throughout the Figures, it is merely representative of one embodiment of the invention. There are a variety of shapes, construction, orientations, and dimensions of reflector assembly 70 that may be used as understood by those skilled in the art. For example, spacing between louver reflectors 72 may be altered to achieve different lighting configurations or the contour of reflective surface 74 may be altered to achieve differing light distribution.

Figure 12:
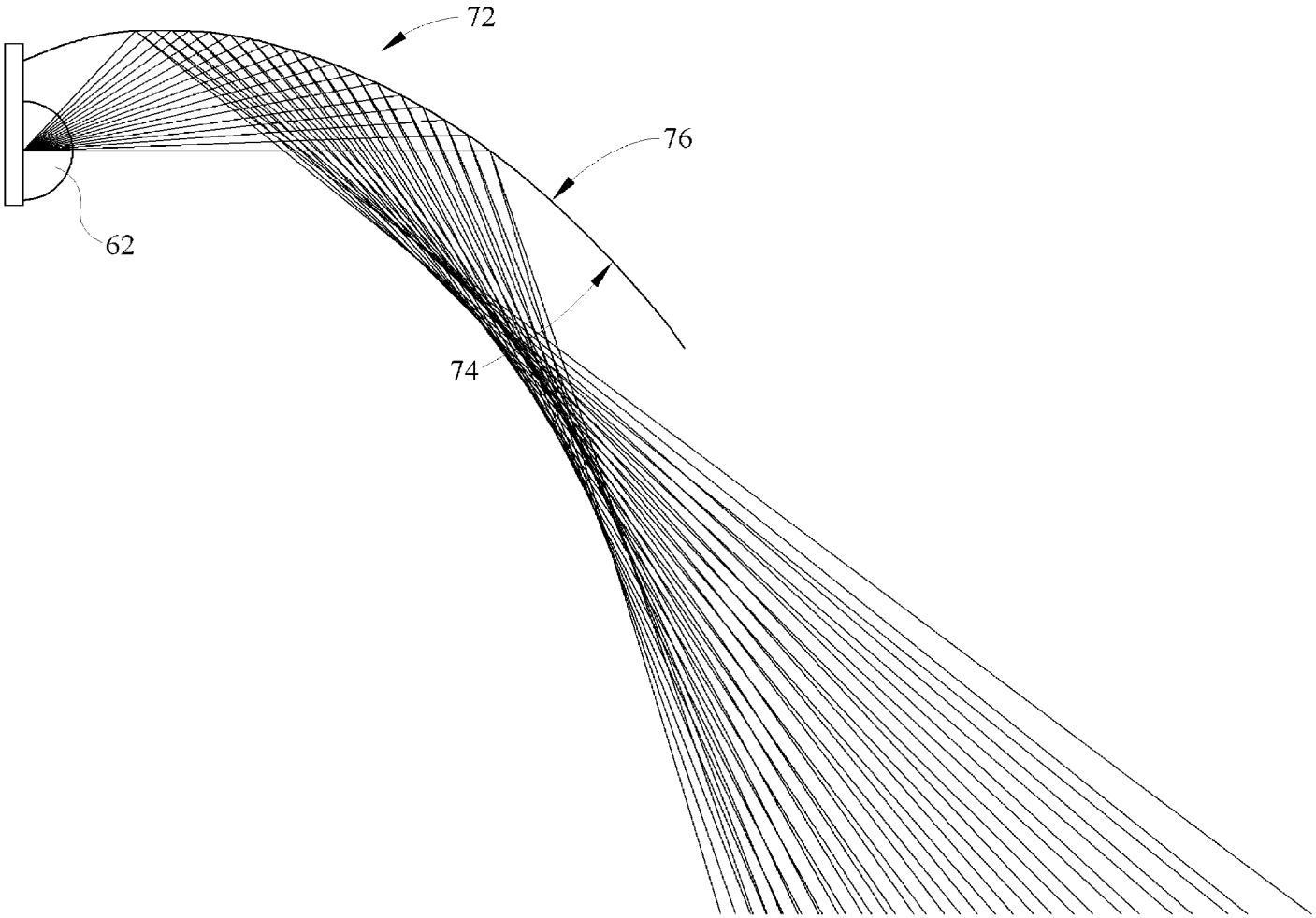
FIG. 12 is a side view of one louver reflector of the louver reflector assembly of FIG. 10 shown with a LED and with a ray trace of a continuous one half of a full width half maximum of exemplary light rays that emanate from the LED and contact the louver reflector.
Figure 13:
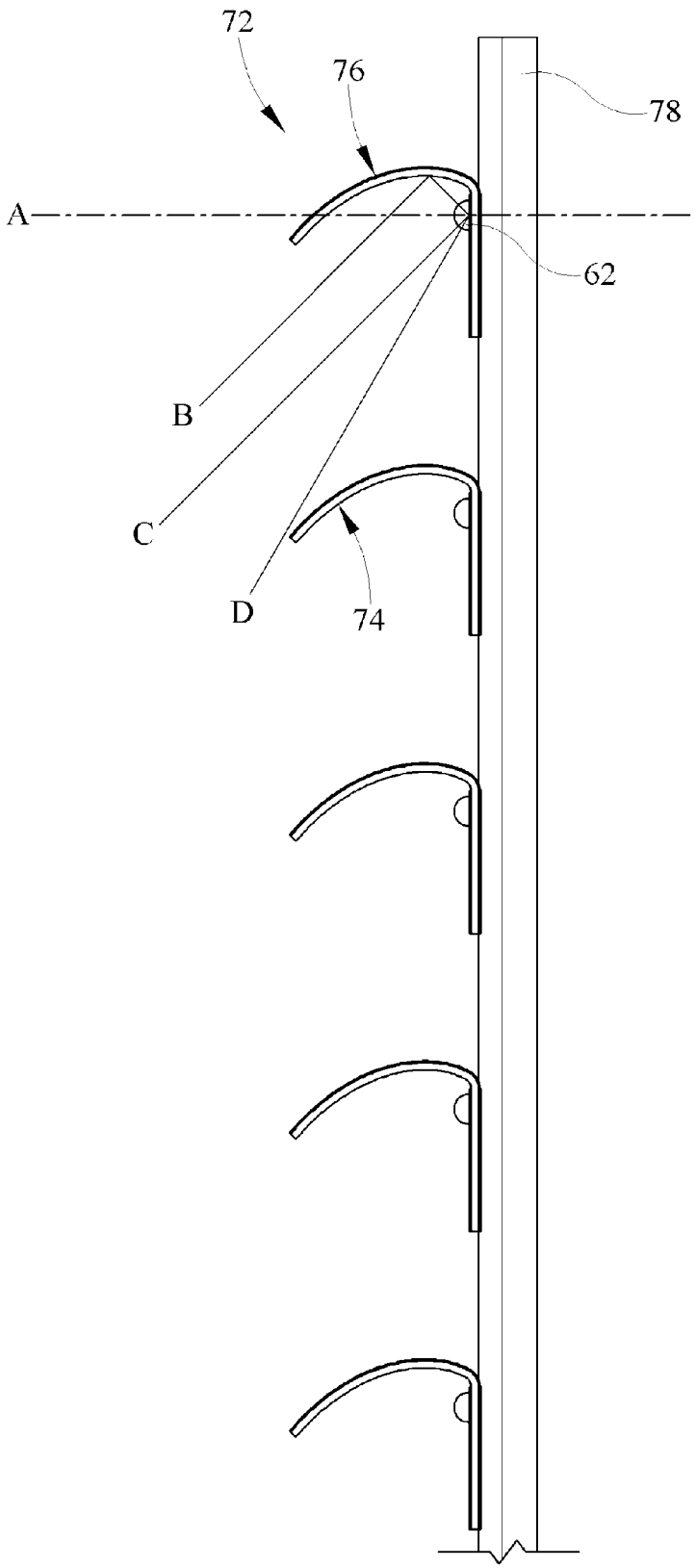
FIG. 13 is an enlarged side view of five LEDs, five louver reflectors, and a reflector frame.
Figure 14:
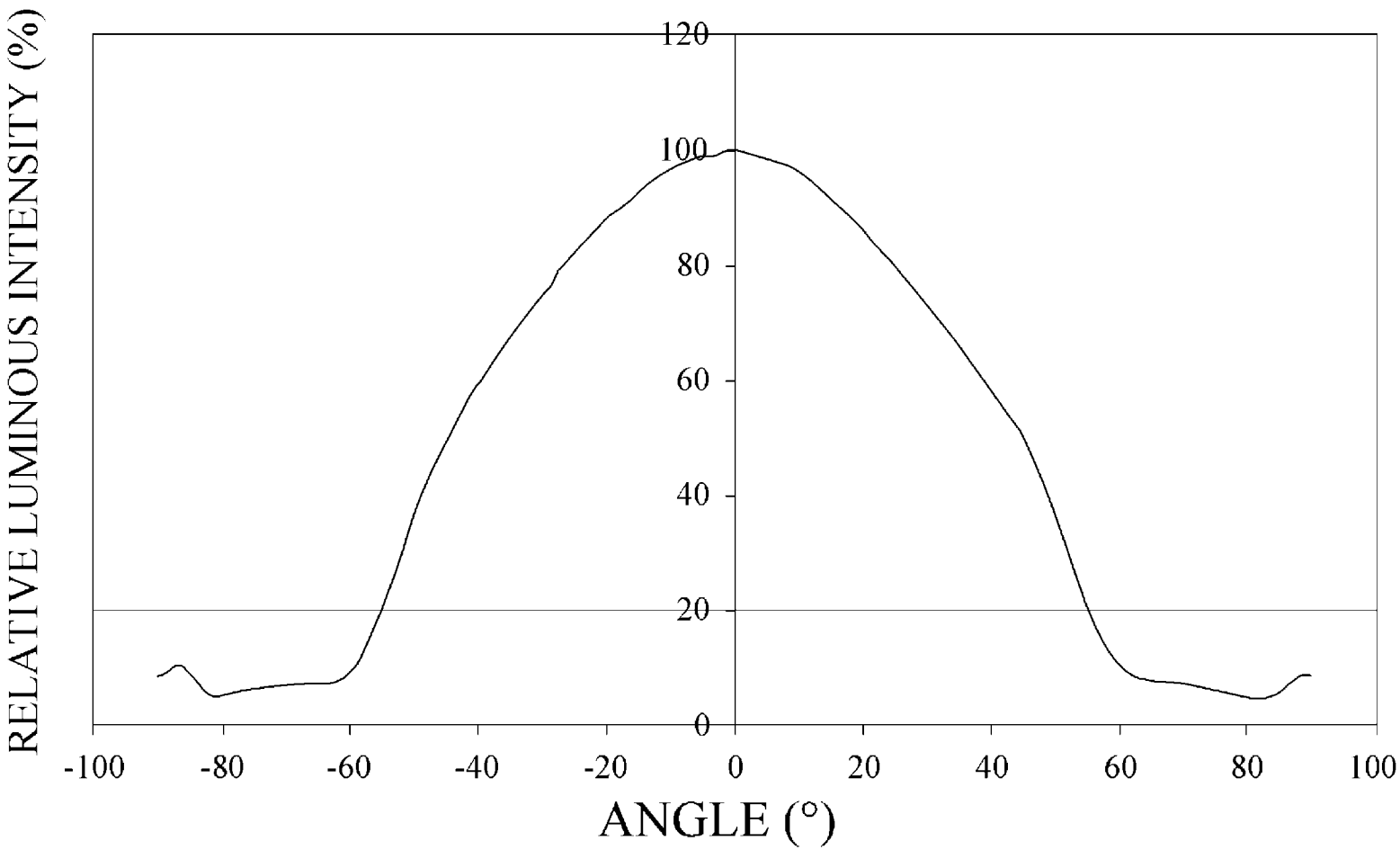
FIG. 14 is a graph of the relative luminous intensity for an LED that may be used with some embodiments of the present invention.

Referring now to FIG. 11 through FIG. 14, one embodiment of louver reflector 72 is described in more detail. The data presented in FIG. 11 through FIG. 14 are merely for illustration and are only exemplary of the multitude of LED and louver reflector configurations that may be used as understood by those skilled in the art. Referring to FIG. 14, the relative luminous intensity for a single LED 62 is shown. The peak relative luminous intensity for LED 62 is at zero degrees. At approximately negative forty-five degrees and forty-five degrees, the relative luminous intensity is approximately 50%. This is approximately a ninety degree range where the luminous intensity is at 50% or greater. This range of angles where the luminous intensity is at 50% or greater is known as the full width half maximum (FWHM). As understood in the art, different LEDs have different FWHM ranges. Again, the ninety degree FWHM of LED 62 is discussed for exemplary purposes and other LEDs may be used as understood by those skilled in the art. Outside of negative sixty degrees and sixty degrees the relative luminous intensity for a single LED 62 is less than 10%.

Referring to FIG. 13, an enlarged side view of five LEDs 62, five louver reflectors 72, and a reflector frame 78 is shown. Louver reflectors 72 are contoured to create a Type III distribution pattern. Other light distribution patterns may be achieved by altering the contour of louver reflectors 72. For example, a type IV distribution pattern may be achieved by decreasing the arc in louver reflector 72 to increase the amount of forward throw of light incident on reflective surface 74 of louver reflector 72.

Dashed line A illustrates a central light output axis of LED 62. Rays that would emanate from LED 62 and follow the direction of dashed line A would correspond to zero degrees on the relative luminous intensity graph of FIG. 14. Ray B and ray C emanate from LED 62 at approximately forty-five and negative forty-five degrees respectively with respect to central light output axis A. Ray B and ray C correspond to those light output angles on the relative luminous intensity graph of FIG. 14. Thus, rays B and C are indicative of the FWHM limits for LED 62. Ray D emanates from LED 62 at approximately negative sixty degrees and corresponds to negative sixty degrees on the relative luminous intensity graph of FIG. 14. Any rays that emanate from LED 62 from negative sixty-one degrees to negative ninety degrees will be incident upon second surface 76 of a neighboring louver reflector 72. Second surface 76 may be painted black to prevent or minimize reflection of the light and to prevent light pollution. As indicated in FIG. 14, any light incident upon second surface 76 will have a luminous intensity of approximately 10% or less, so any uplight from second surface 76 will be minimal.

Figure 11:
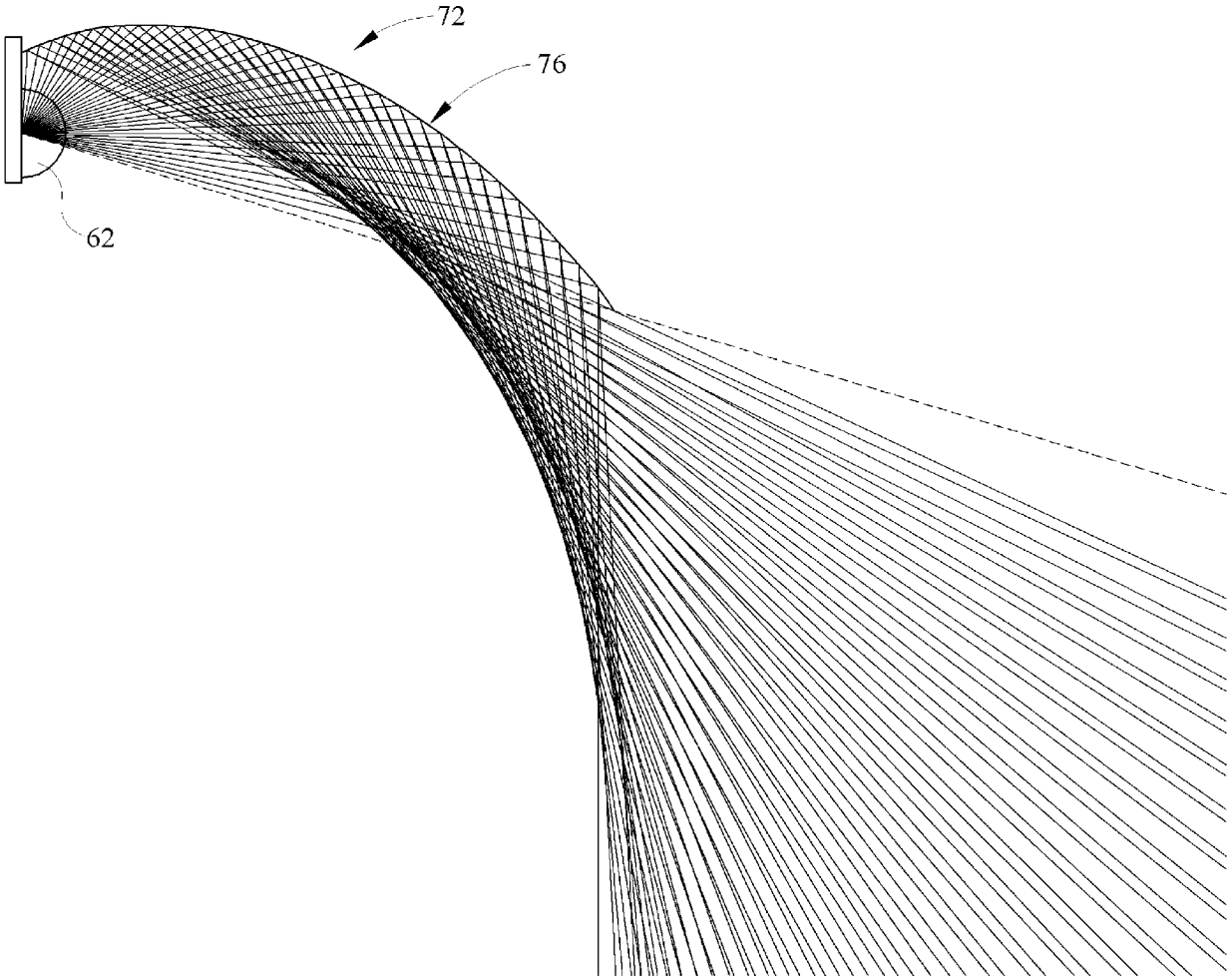
FIG. 11 is a side view of one louver reflector of the louver reflector assembly of FIG. 10 shown with a LED and with a ray trace of exemplary light rays that emanate from the LED and contact the louver reflector.

Referring to FIG. 12, a side view of louver reflector 72 of louver reflector assembly 70 is shown with a LED 62 and with a ray trace of exemplary light rays that emanate from LED 62 from approximately zero to forty-five degrees and contact louver reflector 72. As shown in FIG. 14, the rays from zero to forty-five degrees represent approximately a continuous one half of a FWHM of exemplary light rays that emanate from LED 62. Referring to FIG. 11, a side view of louver reflector 72 of louver reflector assembly 70 is shown with a LED 62 and with a ray trace of exemplary light rays that emanate from LED 32 from approximately ninety to negative thirteen degrees and contact louver reflector 72. The dashed line in FIG. 11 represents approximately negative thirteen degrees.

It will be appreciated that more than one half of the FWHM is reflected by louver reflector 72. In the depicted embodiment, approximately fifty-five degrees of the ninety degree FWHM is reflected. This reflection of the most intense portion of light emitted from LED 62 causes less glare for a user viewing luminaire 10. It will also be appreciated that much of the FWHM that is reflected by louver reflector 72 is redirected toward far edges of the light distribution pattern and is not focused in the center of the light distribution pattern. Also, louver reflectors 72 and LEDs 62 may be advantageously spaced with respect to one another to minimize the viewing angle at which a user could directly view plurality of LEDs 62. In some embodiments each row of LEDs 62 is spaced about one inch from any adjoining row of LEDs 62.

Figure 15:
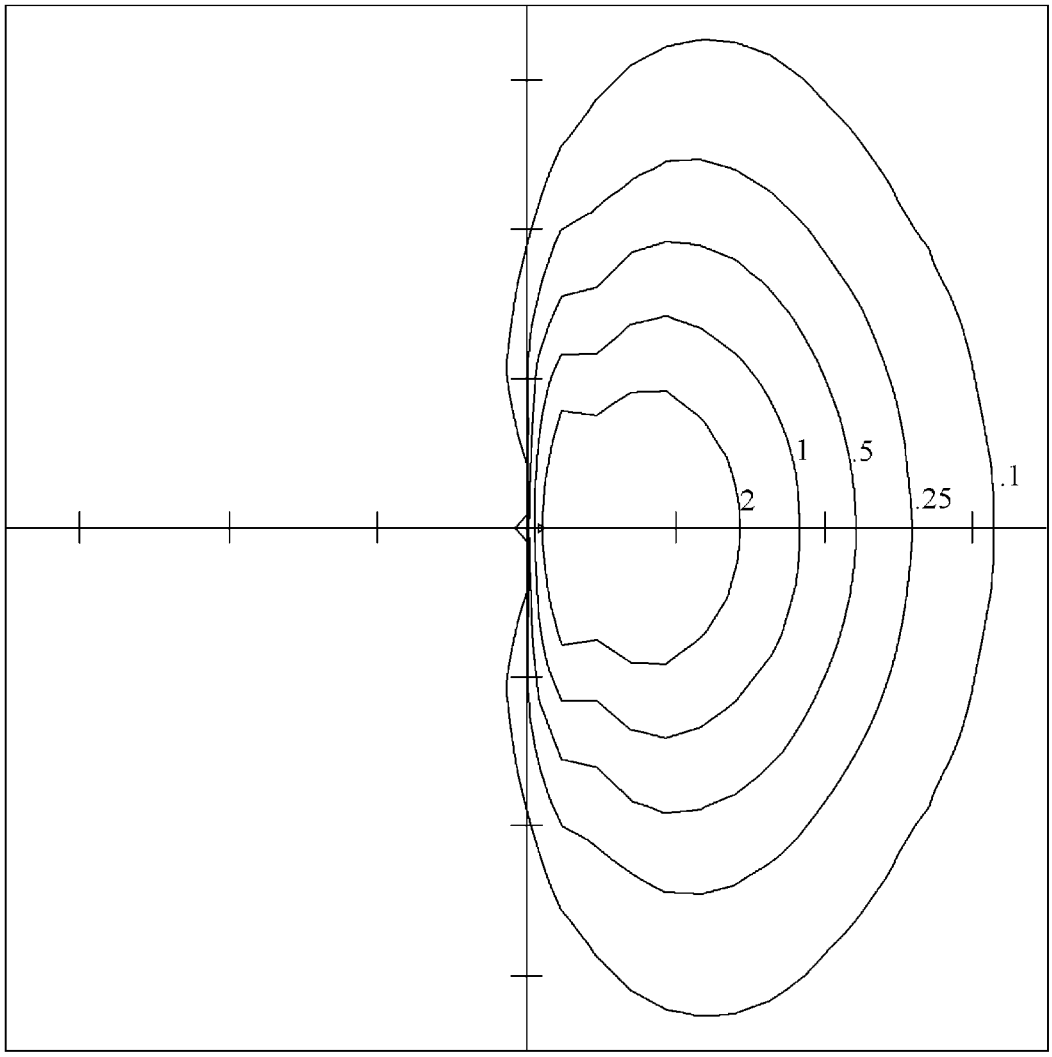
FIG. 15 is a photometric distribution of one embodiment of a luminaire of the present invention.

Shown in FIG. 15 is a photometric distribution of one embodiment of the luminaire comprising sixty-three LEDs 62 arranged in a plurality of LED rows. A type III louver reflector 72 extends along each led row and intersects light output by LEDs 62. The sixty-three LEDs of this embodiment output a total of five thousand nine hundred and eighty five Lumens. The luminaire is mounted at a height of approximately twenty feet and the LEDs are positioned at approximately three tenths of a foot from the center of the photometric distribution. The photometric distribution is in footcandles. Each tic mark on the photometric distribution represents approximately eighteen feet. It should be noted that desirable light distribution is achieved, while backlighting from the fixture is minimized. Backlighting is minimized due in part to the orientation of LEDs 62 and louver reflectors 72 with respect to the illumination surface.

The foregoing description has been presented for purposes of illustration. It is not intended to be exhaustive or to limit the invention to the precise forms disclosed, and obviously many modifications and variations are possible in light of the above teaching. It is understood that while certain forms of the luminaire have been illustrated and described, it is not limited thereto except insofar as such limitations are included in the following claims and allowable functional equivalents thereof.

We claim:

1. An LED based multi-component ground lighting luminaire, comprising:

at least one housing having a first wall portion, a second wall portion, and a vertically extending LED mounting surface extending vertically upward with respect to a lower illumination area;

a housing attachment portion designed for coupling to a support surface;

whereby said first wall portion and said second wall portion extend rearward from said LED mounting surface to said housing attachment portion;

a plurality of LEDs coupled to said LED mounting surface, each of said LEDs oriented to emit a central axis of light output in a light output direction generally away from a corresponding mounting location on said LED mounting surface;

a plurality of reflectors coupled to said housing positioned and configured to reflect a majority of light output from said plurality of LEDs toward said illumination area lying below said plurality of vertically extending LEDs.

2. The LED based multi-component ground lighting luminaire of claim 1 wherein each of said reflectors is a louver reflector configured to reflect at least fifty percent of a full width half maximum of each of said LEDs.

3. The LED based multi-component ground lighting luminaire of claim 2 wherein each of said louver reflectors aligns with at least one row of LEDs on said LED mounting surface.

4. The LED based multi-component ground lighting luminaire of claim 1 wherein said first wall portion, second wall portion, said LED mounting surface and housing attachment portion form an internal airflow channel extending vertically along said luminaire.

5. The LED based multi-component ground lighting luminaire of claim 4 wherein said LED mounting surface has a plurality of cooling fins extending rearward into said internal airflow channel.

6. The LED based multi-component ground lighting luminaire of claim 1 wherein said housing attachment portion is interchangeable with a plurality of configurations.

7. The LED based multi-component ground lighting luminaire of claim 6 wherein said housing attachment portion is concave for attachment to a support pole.

8. The LED based multi-component ground lighting luminaire of claim 6 wherein said housing attachment portion is flat for affixation to a flat surface.

9. The LED based multi-component ground lighting luminaire of claim 1 wherein said housing forms an internal air flow chimney.

10. The LED based multi-component ground lighting luminaire of claim 9 further comprising a plurality of cooling fins extending rearward from said LED mounting surface into said chimney.

11. A vertically extending LED based multi-component ground lighting luminaire, comprising:

a vertically extending luminaire housing having a first wall portion, a second wall portion, a LED mounting surface extending between said first wall portion and said second wall portion, an attachment element extending between said first wall portion and said second wall portion, a first opening proximate a first end of said housing and a second opening proximate a second end of said housing;

an elongated shaft extending within said housing and connecting said first opening to said second opening;

a plurality of rows of LEDs coupled to said LED mounting surface substantially in a first plane and configured to emit a light output;

each of said rows of LEDs oriented to direct a central axis of said light output away from said first plane;

a plurality of reflectors, each of said reflectors coupled to said housing and positioned to reflect light output from at least one of said plurality of LED rows and direct said reflected light toward an illumination plane lying substantially perpendicular to said first plane.

12. The vertically extending LED based multi-component ground lighting luminaire of claim 11 wherein said attachment element is contoured for affixation to a support pole.

13. The vertically extending LED based multi-component ground lighting luminaire of claim 11 wherein said first wall portion of said housing and said second wall portion of said housing extend from said attachment element of said housing at ninety degree angles with respect to one another.

14. The vertically extending LED based multi-component ground lighting luminaire of claim 11 wherein said attachment element is contoured for affixation around approximately ninety degrees of a support pole.

15. The vertically extending LED based multi-component ground lighting luminaire of claim 14 wherein said attachment element is concave.

16. A vertically extending modular luminaire for use with LEDs, comprising:

a housing mounted in a direction extending vertically from a first plane generally representing the ground;

said housing have a first side element, a second side element, an interchangeable rear attachment element and a forward LED mounting element;

said rear attachment element and said forward LED mounting element interposed between said first side element and said second side element;

a plurality of LEDs mountable on said LED mounting element;

wherein said interchangeable rear attachment element has one of a plurality of mounting surface shapes.

17. The vertically extending modular luminaire for use with LEDs of claim 16 wherein said interchangeable attachment element has a rear concave surface for vertical mounting to a pole support.

18. The vertically extending modular luminaire for use with LEDs of claim 16 wherein said interchangeable attachment element has a rear channeled surface.

19. The vertically extending modular luminaire for use with LEDs of claim 16 wherein said interchangeable attachment element has a flat mounting surface for mounting to a garage ceiling surface.

20. The vertically extending modular luminaire for use with LEDs of claim 16 wherein said first side element, said second side element, said rear attachment element and said forward mounting element form an internal chimney, wherein said housing is vertically mounted relative to the ground to allow air to flow through said internal chimney thereby cooling said LEDs.

21. The vertically extending modular luminaire for use with LEDs of claim 16 further comprising a plurality of fins extending from said mounting surface and into said chimney, wherein said fins are in thermal transfer relationship with said plurality of LEDs.

* * * * *